US005358067A

United States Patent [19]

Ford et al.

[11] Patent Number: 5,358,067

[45] Date of Patent: Oct. 25, 1994

[54] FOLDING STEP FOR MOUNTING ABOVE AN INTERIOR CORNER BETWEEN A WALL AND A FLOOR

[75] Inventors: Geoffrey N. Ford, Palmdale; Earl J. Cole, Jr., Canyon Country; Herbert G. Hall, Claremont; Jeffrey A. Souleles, Canyon Country, all of Calif.

[73] Assignee: Lance Camper Mfg. Corp., Pacoima, Calif.

[21] Appl. No.: 122,029

[22] Filed: Sep. 15, 1993

[51] Int. Cl.[5] ..... F06C 9/06

[52] U.S. Cl. ..... 182/91; 182/35; 312/235.1

[58] Field of Search ..... 182/91, 223, 35; 248/293; 312/235.1

[56] References Cited

U.S. PATENT DOCUMENTS

| | | | |
|---|---|---|---|
| 1,953,298 | 4/1934 | Goodwing | 105/447 |
| 2,158,949 | 5/1939 | Sarles et al. | 228/47 |
| 3,030,166 | 4/1962 | Richards | 312/235 |
| 3,136,386 | 6/1964 | Horvath et al. | 182/77 |
| 3,166,277 | 1/1965 | Brison | 244/129 |
| 3,833,089 | 9/1974 | Backwell | 182/91 |
| 4,191,388 | 3/1980 | Barksdale | 182/91 X |
| 4,973,017 | 11/1990 | Takagi | 248/293 |
| 5,085,290 | 2/1992 | Guirlinger | 182/77 |
| 5,094,515 | 3/1992 | Low | 312/235 |
| 5,131,492 | 7/1992 | Caminiti | 182/77 |

*Primary Examiner*—Alvin C. Chin-Shue

*Attorney, Agent, or Firm*—Robbins, Berliner & Carson

[57] ABSTRACT

A folding step assembly is attached to a wall at a predetermined height above a floor and is movable from a stowed position to an operative position. The step assembly includes a step member providing a step surface between an inner and outer edge, an inner hinge attaching the inner edge of the step member to the wall or wall recess at a desired height, a brace having an inner edge and an outer edge, an outer hinge attaching the outer edge of the step member to the inner edge of the brace, and a stop for limiting the angle between the step member and the brace to thereby maintain the brace at an acute angle relative to the step member. In the stowed position, the brace is substantially parallel to the step member and the step member is substantially parallel to the wall or the inside of the wall recess. In the operative position, the step member is substantially parallel to the floor and the brace is maintained at an acute angle relative to the step member with the outer edge of the brace extending into an inside corner defined by the wall and the floor.

4 Claims, 3 Drawing Sheets

FOLDING STEP FOR MOUNTING ABOVE AN INTERIOR CORNER BETWEEN A WALL AND A FLOOR

BACKGROUND

Field of the Invention

The invention relates generally to folding steps to facilitate access to elevated spaces, and more particularly to folding steps that are adapted to be mounted to a wall above an adjacent floor.

Prior Art

Campers by their very nature must economize space and allow easy access to all living and storage spaces, some of which may be relatively high above the truck bed which supports the main floor of the camper. In some cab-over campers, a large step having an interior storage compartment provides able bodied adults access to a sleeping compartment above the truck cab.

Folding steps have been built into cabinets used in kitchens and other cramped areas to allow shorter persons safe access to upper shelves and storage compartments. Such steps fold away when not used to economize living space.

U.S. Pat. No. 1,953,298 (Goodwin) and U.S. Pat. No. 2,158,949 (Sarles) disclose steps that unfold from walls supported by a single hinge attached to the wall. These cantilevered designs require walls capable of withstanding significant shear forces and the single hinge must be able to withstand significant torque to support the weight of the person (typically a child or small adult) using the step.

U.S. Pat. No. 5,085,290 (Guirlinger), U.S. Pat. No. 3,136,386 (Horvath), U.S. Pat. No. 3,030,166 (Richards) and U.S. Pat. No. 5,131,492 (Caminiti) all disclose step assemblies that unfold from a wall and which include vertical floor engaging members that are designed to support the weight of a large adult. Provided it is maintained in a vertical position, the support from the floor engaging members reduces the requirement of the wall to withstand significant shear forces and reduces the requirement of the attached hinge to withstand significant torque.

U.S. Pat. No. 3,166,277 (Brison) and U.S. Pat. No. 5,094,515 (Low) disclose step assemblies that unfold from the wall and are intended to support the weight of a large adult. The Brison device comprises tracks that must be mounted to the wall to support and align the step and the supporting member. The Low device comprises a vertical floor engaging member to support the weight.

SUMMARY

The present invention is directed to a folding step assembly for attaching to a wall or wall recess that is easily stored when not in use and comprising minimal parts. The step assembly comprises a step member with a step surface between an inner and outer edge, means for horizontally hinging the inner edge of the step member to the wall or wall recess at a desired height, a brace with an upper edge and a lower edge, means for hinging the outer edge of the step member to the upper edge of the brace, and means for stopping the angle Θ of separation between the step member and brace to position the brace to support the step member when downward force is applied to the step surface. The step assembly is movable from a folded position, wherein the brace rests parallel against the step member and the step member rests parallel against the wall or inside of the wall recess, to an unfolded position, wherein the step member is unfolded from the wall or wall recess, the brace is unfolded from the step member and the lower edge of the brace rests in the joint between the wall and a floor adjoining the wall.

As described, the present invention can be manufactured from few parts and is easily installed by hinging the step to a wall or inside of a wall recess. The step member, brace and the connecting hinges can be easily manufactured and assembled together in a factory. Installation requires merely attaching the inner edge of the step member to a wall at the appropriate height. Optionally, the inner edge of the step member can be attached to a wall recess so that the assembly in its folded position fits flush with the wall.

A salient advantage of the present invention is that it provides substantial support and stability when shear forces are applied to the step member and/or to the brace. The invention accomplishes this by engaging the lower end of the brace in the joint where the wall and floor meet. This provides greater stability for the step member than if the brace only engaged the floor or the wall, where it could inadvertently be kicked or otherwise displaced from its intended position.

DESCRIPTION OF A PREFERRED EMBODIMENT

Figure 1:
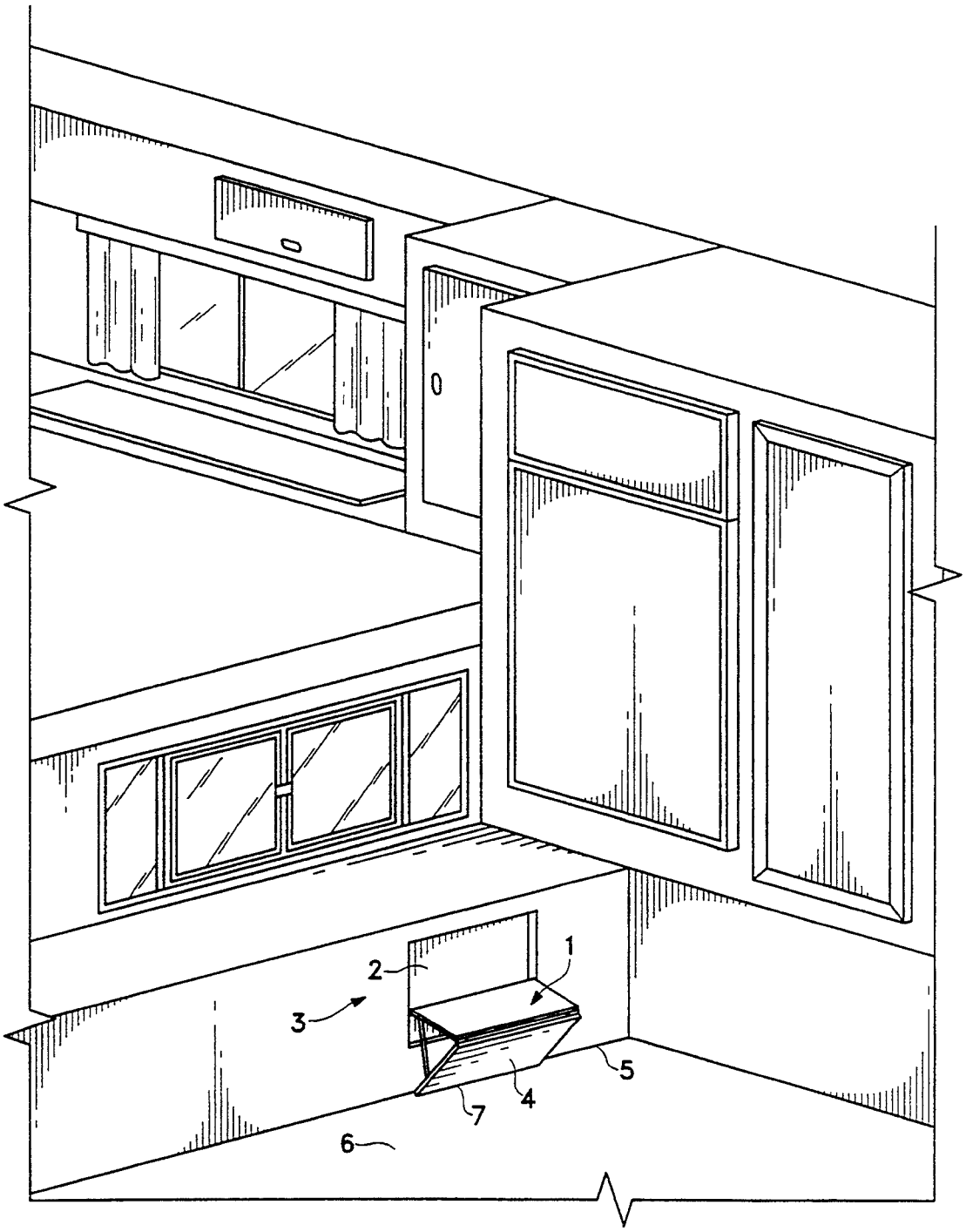
FIG. 1 is a view of the step assembly installed in the wall of the interior of a camper to allow for access to the cab-over living space. The step assembly is shown in the operative (unfolded) position.

FIG. 1 is a view of the step assembly 1 installed in the wall recess 2 in the front of a camper to allow for access to the cab-over living space. Alternatively, the step assembly 1 can be installed onto wall 3 without a recess. The step assembly 1 is shown in the unfolded position with the lower edge of brace 7 fitting in joint 5 where wall 3 and floor 6 meet.

Figure 2:
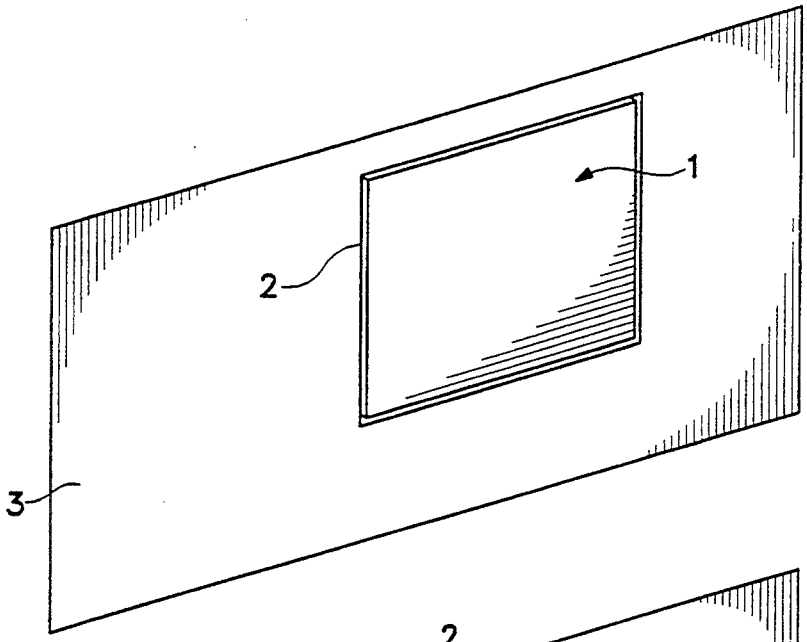
FIG. 2 is a view of the assembly attached to a wall recess and in the stowed (folded) position fitting flush with the wall.

FIG. 2 is a view of the step 1 in the folded position. The step assembly 1 rests flush with wall 3 when installed in a wall recess 2. When installed on wall 3 with no wall recess 2, the step assembly 1 protrudes above the surface of wall 3. Preferably at least the outer surface of brace 4 is covered with carpet or other scuff resistant wall covering matching that provided on the remainder of wall 3.

Figure 3:
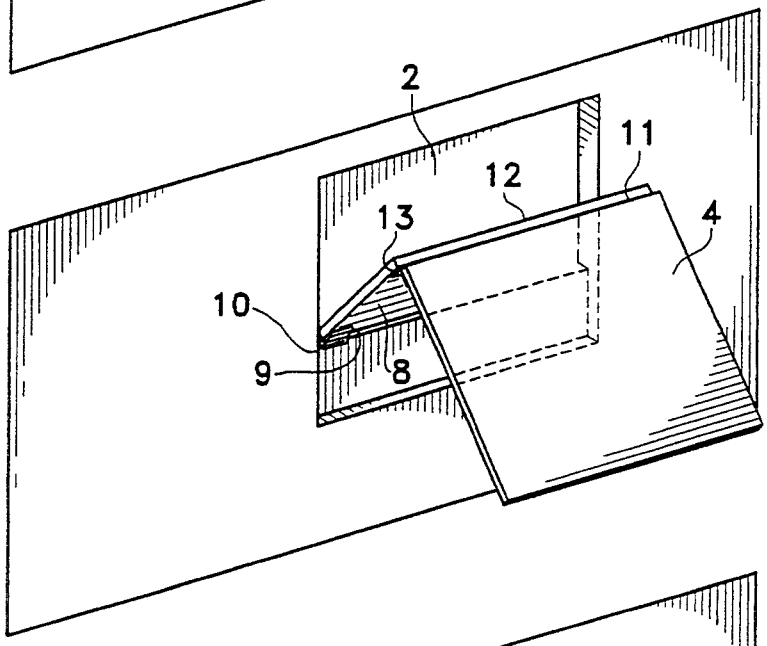
FIG. 3 is a view of the assembly in an intermediate position between the folded and unfolded positions.

FIG. 3 is a view of step assembly 1 in an intermediate position between the folded and unfolded positions. The step member 8 rotates about its inner edge of step member 9 which is attached to wall recess 2 by inner hinge 10. The brace 4 rotates about its upper edge 11 that is attached to outer edge of step member 12 by outer hinge 13.

Figure 4:
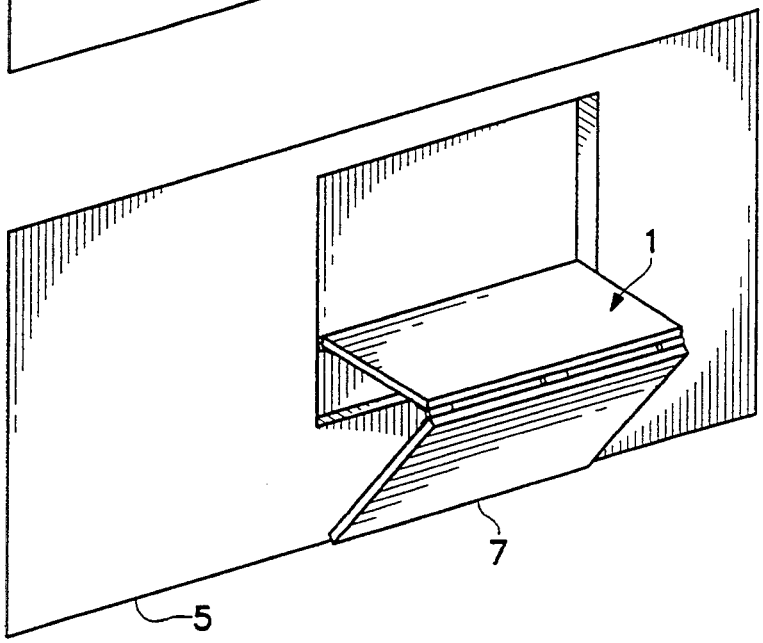
FIG. 4 is a view of the assembly in the unfolded position with the lower edge of the brace resting in the joint between the wall and the floor.
Figure 5:
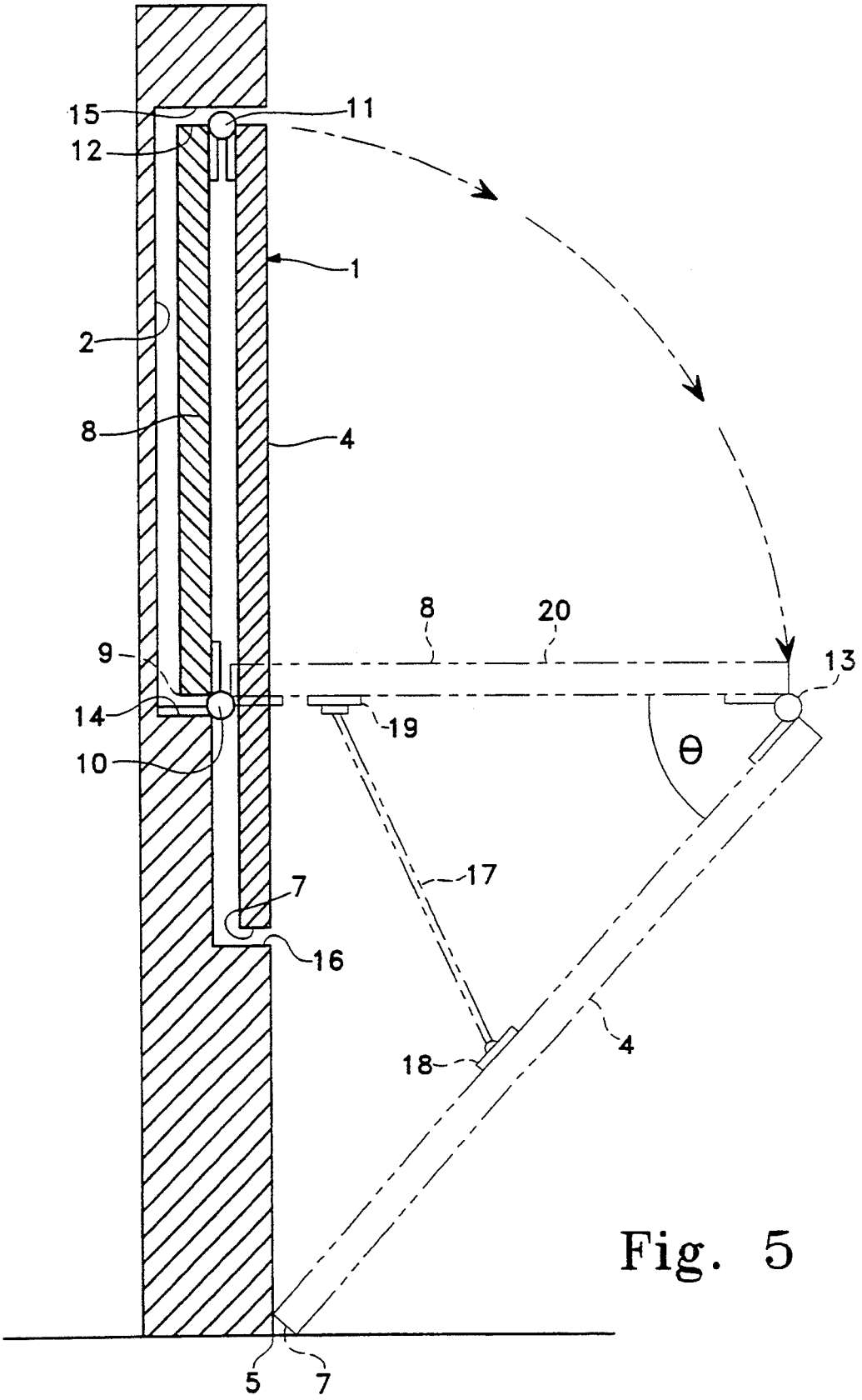
FIG. 5 is a cross-section view of the assembly installed in a wall recess. The assembly is shown in the folded position fitting flush with the wall and in the unfolded position with the lower edge of the brace resting in the joint between the wall and the floor and with the limit cable taut.

FIG. 4 is a view of the step assembly 1 in the unfolded position with the lower edge brace 7 resting in joint 5. FIG. 5 is a cross-section of step assembly 1 in the folded and unfolded positions installed in wall recess 2. The inner hinge 10 is attached to first lower edge 14 of wall recess 2. While in the folded position, the step member 8 rests with the inner edge 9 of step member 8 at first lower edge 11 of wall recess 2 and with the outer edge 12 of step member resting at the upper edge 15 of wall recess 2, and with the upper edge 11 of brace 4 resting at upper edge 11 of wall recess 2 and lower edge 7 of brace 4 resting at second lower edge 14 of wall recess 2.

In the unfolded position as shown in FIG. 5, the step member 8 rests substantially horizontal and the brace 4 extends from attachment at outer edge 12 of step member 8 to joint 5. The limit cable 17, attached to brace 4 at first end 18 of limit cable 17 and attached to step member 8 at second end 19 of limit cable 17 is pulled taut when the step assembly 1 is in its unfolded position and the angle Θ separating step member 8 and brace 4 is such that the step member 8 is substantially horizontal and the lower edge 7 of brace 4 fits into joint 5, The angle separating step member 8 and brace 4 can also be limited by mitering upper edge of brace 11 with outer edge 12 of step member 18.

The step assembly 1 is installed by attaching inner hinge to first lower edge 14 of wall recess 2. This can be accomplished by any conventional fastening means appropriate to the materials involved, for example by screws, nails or welding. When step assembly 1 is in the unfolded position and weight is applied to step surface 20, the vertical force applied thereon is distributed to brace 4 through outer hinge 13 and to inner hinge 10 where attached to first lower edge 14. The brace lower edge 7 is thereby urged into joint 5 formed by wall 3 and floor 6, where it is restrained both vertically and horizontally.

It should be understood that the above-described embodiment is merely provided to illustrate the principles of the present invention, and that other embodiments may readily be devised using these principles by those skilled in the art without departing from the scope and spirit of the invention.

What is claimed is:

1. A folding step assembly attached to a wall above a floor, with said wall and floor defining an interior corner, the assembly comprising:

a step member having a step surface extending between an inner edge and an outer edge;

means horizontally hinging the inner edge of the step member to the wall at a desired height, such that the step member has a substantially vertical folded position in which the step member rests parallel against the wall and a substantially horizontal unfolded position in which the step member extends away from the wall;

a brace having an upper edge and a lower edge;

means for hinging the outer edge of the step member to the upper edge of the brace, such that the brace has a folded position in which the brace rests parallel against the step member and an unfolded position in which the brace extends below the step member; and means for limiting the angle between the step member and the brace to a predetermined acute angle with the brace in said unfolded position;

wherein the step assembly is movable from a folded position with the outer edge of the step member resting above the inner edge of the step member, said an unfolded position with the lower edge of the brace resting in said interior corner defined by the wall and said floor, whereby the unfolded brace supports the outer edge of the step member when the step member is unfolded from the wall.

2. The folding step assembly of claim 1, wherein the means for limiting the angle between the step member and the brace consists of a limit cable having a first end secured to the step member and a second end secured to the brace, such that limit cable is pulled taut when the assembly is in the unfolded position.

3. The folding step assembly of claim 2, wherein the assembly is attached to the inside of a wall recess and the step member and brace fit inside the wall recess with the brace resting substantially flush with the wall when the assembly is in the folded position.

4. The folding step assembly of claim 3, wherein at least a portion of the brace and of the wall are both covered with a same scuff-resistant wall covering.

* * * * *